US006674870B1

(12) United States Patent
Price

(10) Patent No.: US 6,674,870 B1
(45) Date of Patent: Jan. 6, 2004

(54) ADJUSTABLE SOUND CAPTURING DEVICE (MICTUBZ)

(75) Inventor: Scott C. Price, 1801 Greencastle Dr., Baltimore, MD (US) 21237

(73) Assignee: Scott C. Price, Baltimore, MD (US)

( * ) Notice: Subject to any disclaimer, the term of this patent is extended or adjusted under 35 U.S.C. 154(b) by 0 days.

(21) Appl. No.: 10/227,399

(22) Filed: Aug. 24, 2002

(51) Int. Cl.[7] ..... H04R 25/00
(52) U.S. Cl. ..... 381/361; 381/362; 181/22
(58) Field of Search ..... 381/355, 356, 381/357, 361, 362, 382, 338, FOR 147, FOR 148, 26, 92, 337; 181/20, 21, 22

(56) References Cited

U.S. PATENT DOCUMENTS 1,955,139 A * 4/1934 Martin ..... 181/22
3,542,149 A * 11/1970 Ronka ..... 381/338

* cited by examiner

*Primary Examiner*—Curtis Kuntz
*Assistant Examiner*—Brian Ensey

(57) ABSTRACT

An adjustable sound capturing device 2 ("MICTUBZ") having a hollow main cylinder 20 open at both ends with a central microphone port 22 defined in the side wall, the microphone port 22 being equipped with an adjustable fastener 30 for seating the head of a conventional microphone 50 therein. In addition, two rotatable and telescoping cylindrical end tubes 10A, 10B are mounted on the open ends of the main cylinder 20, each having one open end, one closed end, and an acoustic input port 12 defined in its side wall, proximate the closed end, for channeling sound from spaced instruments to the centrally-mounted microphone 50. When a conventional microphone 50 is mounted on an existing mike stand, the adjustable sound capturing device 2 can be attached to the microphone 50 and adjusted to effectively double the pickup capacity of a single microphone 50 and to selectively pick up the sounds of two spaced-apart instruments without also picking up ambient sounds or other noise.

16 Claims, 4 Drawing Sheets

ADJUSTABLE SOUND CAPTURING DEVICE (MICTUBZ)

BACKGROUND OF THE INVENTION

1. Field of the Invention

The present invention relates to microphone recording accessories and, more particularly, to a tubular adjustable sound capturing device having a microphone input port and two articulating end ports for channeling sound from distal instruments to a centrally-mounted microphone.

2. Description of the Background

A problem arises when a conventional microphone is employed to pick up the sounds of a particular musical instrument that is being played in a group with other instruments. It is difficult to selectively pick up only the intended sounds of an instrument without also picking up unintended sounds from one or more of the other instruments (known as bleed-over). This problem is greatest where the output of the particular instrument that is being selectively miked is relatively low while other nearby instruments have a relatively high output level.

The current miking technique for studio recordings and live performances consists of positioning multiple microphones on stands in front of each instrument to be recorded. For example, drums are most commonly miked using a method known as "open air miking." This requires each individual component of the drum set to have its own individual microphone pointing directly towards it. The existing technique has several disadvantages. Microphones must be handled with care because they contain delicate electronic components. Bands and musicians are forced to transport large numbers of microphones from show to show and are always at risk of dropping or damaging them. Moreover, the more microphones needed for recording studio and live performances increases the amount of time wasted on set up and tear down. Expense also becomes an issue especially for drum sets, where each drum set generally requires eight microphones for recording or live performance. With an average cost of $100.00 per unit ($800.00 total), the total cost adds quickly. For each microphone purchased there is also the added expense of the microphone cable, clip and stand (these necessary accessories are usually sold separately). Ironically, more money can be spent on the microphones and accessories than the actual drum set. "Bleed-over" is another problem. Open air miking captures the intended sound as well as other unwanted sounds emitted from the band or other sections of the drum kit. Thus, "bleed-over" occurs because sound waves are reaching each microphone head from all angles. It would be highly desirable to reduce the cost of multiple microphones, set-up time and possibility of unwanted sound waves reaching each microphone head.

The foregoing may be accomplished with an accessory that can be attached to a variety of conventional microphones, the device having distally-spaced input ports that effectively double the pickup capacity of the microphone and selectively pick up the sounds of spaced-apart instruments without also picking up ambient sounds or noise. The general concept of a microphone housing with spaced input ports is known, albeit in a different context (noise cancellation technology, comprising electronic components without the benefit of total adjustability).

For example, U.S. Pat. No. 5,282,245 to Anderson issued Jan. 25, 1994 shows a tubular bi-directional microphone with flared entries. The tubular member has flared spaced entries, but the goal is to cancel noise. Noise will enter both sides of the tube and will deflect the mike from both sides, effectively canceling out.

Similarly, U.S. Pat. No. 4,837,836 to Barcus issued Jun. 6, 1989 shows a microphone pickup system in which the mike is seated in an elongated flat channel extending between oppositely facing open ends. This system provides improved response characteristics for the harmonica, accordion and drum.

None of the foregoing or any other known prior art devices suggest a simple tubular structure with adjustability benefits (rotational and lengthwise) for selectively channeling the sounds of spaced-apart instruments to an existing microphone without also picking up ambient sounds or noise. Moreover, none of the foregoing suggests an adjustable device (microphone accessory) that can be attached to a variety of existing conventional microphones, that has no electronic components, and that does not require its own power source.

In light of the foregoing there remains a need for an adjustable sound capturing device that can be attached to a variety of conventional microphones, the device having fully adjustable, distally-spaced input ports that effectively double the pickup capacity of the microphone and selectively pick up the sounds of spaced-apart instruments without also picking up ambient sounds or noise.

SUMMARY OF THE INVENTION

It is, therefore, an object of the present invention to provide an adjustable sound capturing device that can be attached to a variety of conventional microphones.

It is another object to provide an adjustable sound capturing device having distally-spaced input ports that effectively double the pickup capacity of a microphone and selectively pick up the sounds of spaced-apart instruments without also picking up ambient sounds or noise.

It is a more particular object to provide an adjustable sound capturing device with articulating distally-spaced input ports that can be adjusted in position near two spaced-apart instruments to effectively double the pickup capacity of a single existing microphone to selectively pick up the sounds of the instruments without also picking up ambient sounds or noise.

It is still another object to allow musicians to use a single microphone to effectively do the job of two, thereby reducing the number of accessories required for recording or live performance (stands, clips, cables, etc).

It is another object to provide an adjustable sound capturing device that offers maximum strength and durability, and yet is portable and well-suited for touring productions in order to reduce the number of microphones that need to be transported for live performances, thus minimizing the risk of damage.

It is still another object to provide an adjustable sound capturing device as described above that is simple and economical, more cost-effective than purchasing multiple microphones and mixing them electronically, and which requires no power source, contains no electronics, and is much simpler to use.

It is another object to virtually eliminate bleed-over problems associated with current microphones and miking techniques.

It is another object to allow musicians to use unidirectional microphone(s) in traditionally undesirable situations and to allow unidirectional microphones to effectively pick up two or more sounds with clarity and reduced bleed-over being achieved in both situations.

It is yet another object to allow musicians to use unidirectional microphone(s) in traditionally undesirable situations and to allow unidirectional microphones to effectively pick up two or more sounds with clarity and reduced bleed-over being achieved in both situations.

According to the present invention, the above-described and other objects are accomplished by providing a three-member tubular adjustable sound capturing device ("MICTUBZ") having a hollow main cylinder open at both ends with a central microphone port defined in its side wall, the microphone port being equipped with an adjustable fastener for seating the head of a conventional microphone therein. In addition, two hollow, rotatable and telescoping, cylindrical tubes slide over the open ends of the main cylinder, each having one open end, one closed end, and an acoustic input port defined in its side wall, proximate the closed end, for channeling sound from spaced instruments to the centrally-mounted microphone. When a conventional microphone is mounted on an existing mike stand, the MICTUBZ can be attached to that microphone and adjusted to effectively double the pickup capacity of a single microphone and to selectively pick up the sounds of two spaced-apart instruments without also picking up ambient sounds or other noise (bleed-over).

Of course, many modifications of the general concept would be apparent to those skilled in the art, and all are considered to be within the scope and spirit of the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
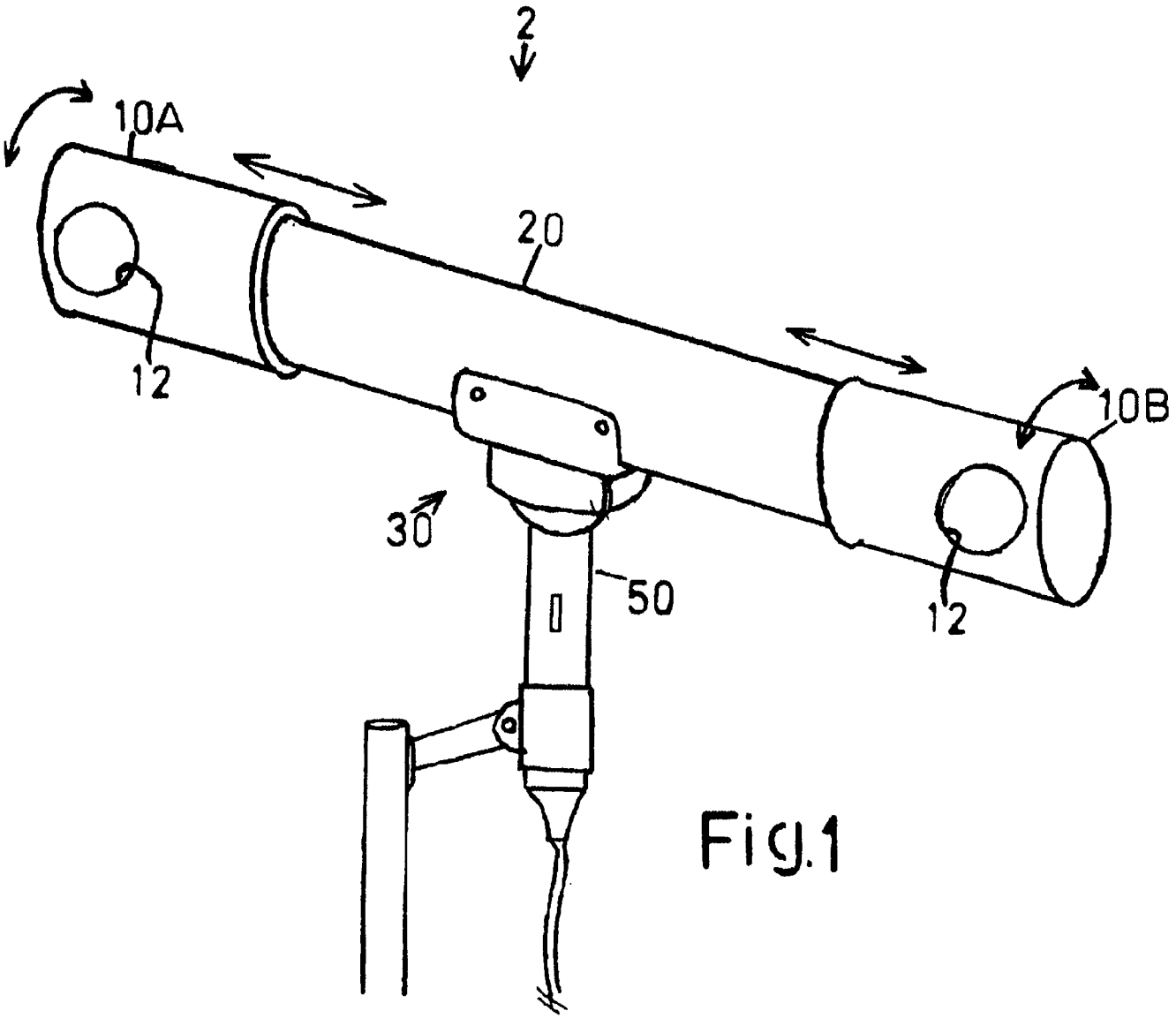
FIG. 1 is a perspective drawing of a preferred embodiment of the present invention comprising a tubular adjustable sound capturing device ("MICTUBZ") 2.

FIG. 1 is a perspective drawing of a preferred embodiment of the present invention comprising a tubular adjustable sound capturing device ("MICTUBZ") 2.

The adjustable sound capturing device 2 generally comprises a hollow, open-ended main cylinder 20 having a central microphone port (obscured) defined in its bottom side wall. The microphone port is surrounded by an adjustable head-mount 30 for seating the head of any one of a variety of different-sized conventional microphones 50. In addition, two hollow, rotatable and telescoping, cylindrical end tubes 10A and 10B slide over the open ends of the main cylinder 20. Each end tube 10A, 10B is closed at one end and is defined by an acoustic input port 12 through its side wall proximate the closed end. The adjustable sound capturing device 2 essentially forms a T-junction for channeling sound from two spaced instruments to a centrally-mounted microphone 50 seated in head-mount 30. When the microphone 50 is mounted on an existing mike stand (as shown), the adjustable sound capturing device 2 can be attached to the head of the microphone 50. The end tubes 10A, 10B can be adjusted laterally and rotated to selectively position the input ports 12 directly in front of two different instruments, thereby effectively doubling the pickup capacity of the single microphone 50 in order to selectively pick up the sounds of the two spaced-apart instruments while also deflecting ambient sounds and noise.

Figure 2:
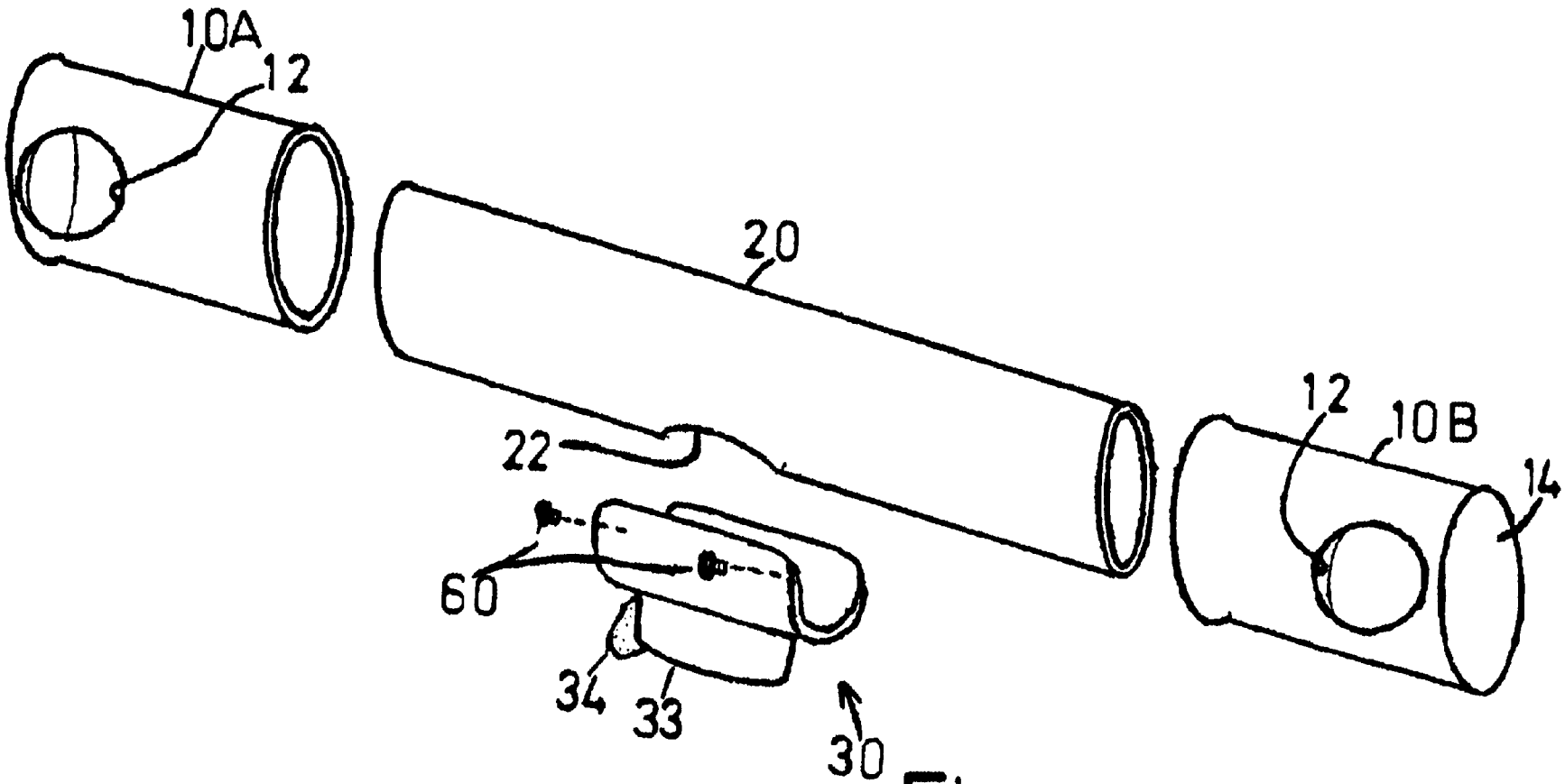
FIG. 2 is an exploded perspective view of the adjustable sound capturing device 2 of FIG. 1 illustrating the attachment of the various components.

FIG. 2 is an exploded perspective view of the adjustable sound capturing device 2 of FIG. 1 illustrating the attachment of the various components.

The adjustable head-mount 30 conforms to the shape of the main cylinder 20 and is securely attached thereto by rivets 60 or other like means. The head-mount 30 includes a downwardly protruding collar 33 that fits around the microphone 50. A hook-and-loop fastening strap 34 is fitted around the collar 33 for constriction thereof, and this provides a secure mounting to the microphone 50.

The two cylindrical end tubes 10A, 10B are friction-fit onto both open ends of the main cylinder 20 and remain free to rotate and/or telescope outward. This allows precise positioning the respective acoustic input ports 12 defined therein in front of two spaced-apart instruments or drum components.

Figure 3:
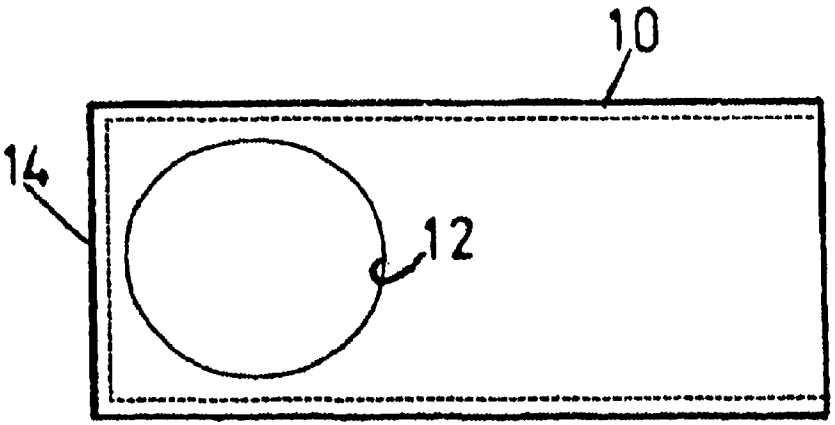
FIG. 3 is a side cross-section of an exemplary end tube 10.

FIG. 3 is a side cross-section of an exemplary end tube 10, the two end tubes 10A, 10B being identical for economy of manufacture. Each end tube 10 is a short length of plastic tubing approximately 5" long with ⅛" thick walls. The end tube 10 is closed at one end by wall 14. The inside diameter is carefully chosen to conform to the outside diameter of the main cylinder 20 to allow end tubes 10 to fit snugly yet slide over the smaller diameter main cylinder 20. Preferably, the end tubes 10A, 10B as well as the main cylinder 20 are constructed of polyurethane or PVC plastic, both tough and durable materials with good abrasion and tear resistance, and high load bearing capacity. More importantly, these are good sound dampening materials that offer increased noise abatement. It should be understood that other sound dampening materials may be equally-well suited for the present application. Each end tube 10 is also provided with a circular acoustic input port 12 proximate the end wall 14. The acoustic input ports 12 are approximately 1½" apertures opening in the side of the end tubes 10.

Figure 4:
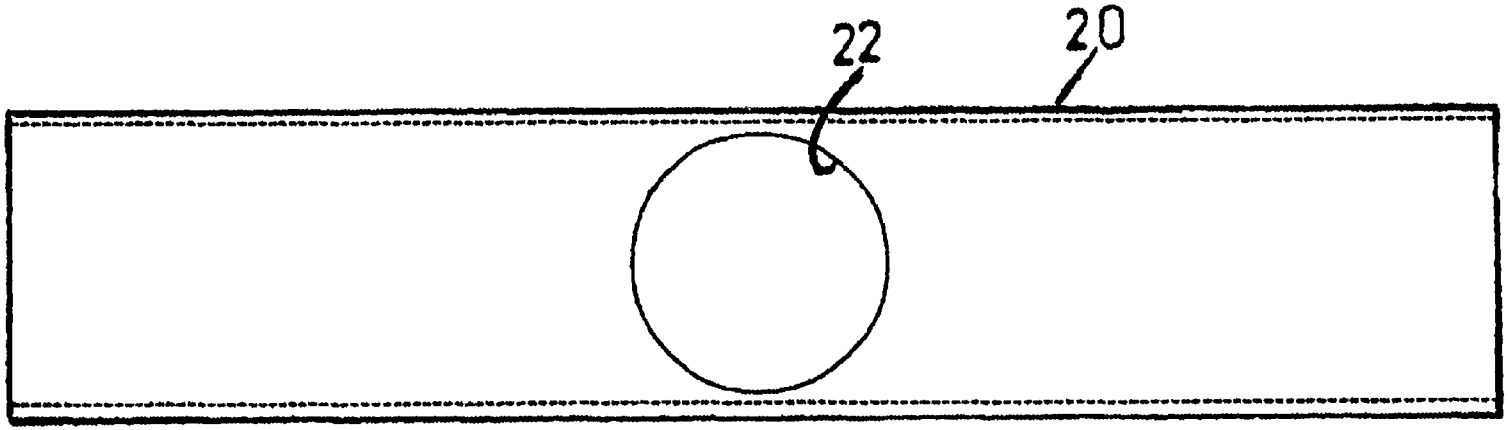
FIG. 4 is a side cross-section of the main cylinder 20, constructed of like material as the end tubes 10.

FIG. 4 is a side cross-section of the main cylinder 20, constructed of like material as the end tubes 10. In a preferred embodiment, the main cylinder 20 is 8" long as a matter of design choice, and also has approximately ⅛" thick walls. The outside diameter is carefully chosen to conform to the inside diameter of the end tubes 10. The main cylinder 20 remains open at both ends. The main cylinder 20 is also provided with a circular microphone port 22 located centrally along its length. The microphone port 22 is an approximate 1½" aperture opening centrally into the side of the main cylinder 20.

Figure 5:
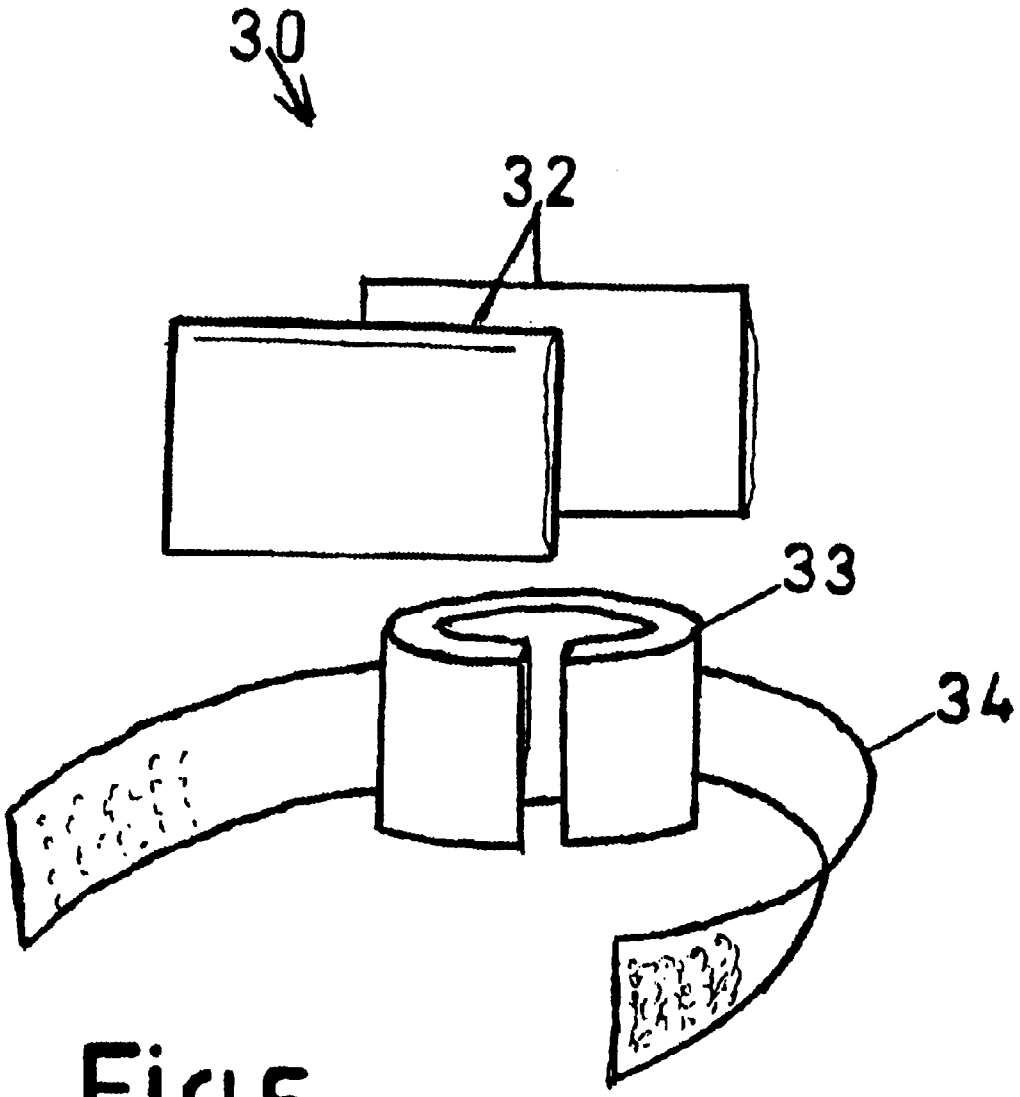
FIG. 5 is an exploded perspective view of an exemplary adjustable head-mount 30.

FIG. 5 is an exploded perspective view of an exemplary adjustable head-mount 30. Head mount 30 comprises two resilient pads 32 which are riveted or otherwise attached on opposing sides of the microphone port 22 to form a skirt thereabout. Head mount 30 also includes a truncated collar 33 that is sandwiched between the two pads 32 (and retained by adhesive). The truncated collar 33 is a generally annular member protruding downwardly beneath the microphone port 22. Collar 33 fits around the microphone 50. Collar 33 is interrupted by a lengthwise channel which allows it to be constricted. Both the pads 32 and collar 33 are preferably formed of rubber or other resilient material. In addition, head-mount 30 includes a hook-and-loop fastening strip 34 that is attached to collar 33 and encircled thereabout for maintaining the collar 33 in a constricted state. The foregoing head-mount 30 inclusive of skirt pads 32, collar 33 which fits around the microphone 50, and hook-and-loop fastening strap 34 for constriction of collar 33 is one example of a secure means for mounting to the head of microphone 50. It should be understood that other configurations may achieve the same purpose without departing from the scope or spirit of the present invention.

In operation of the adjustable sound capturing device 2 as illustrated in FIGS. 1–5, a microphone 50 is inserted into the open head-mount 30 such that the microphone's head abuts the microphone port 22. Hook-and-loop fastening strip 34 is tightened and attached to itself in order to constrict the collar about microphone 50. The end tubes 10A, 10B are then adjusted by rotation and/or laterally to position the acoustic input ports 12 directly in advance of the intended instruments (e.g., the snare drum and hi-hats of a drum set). Having done this, the distally-spaced input ports 12 effectively double the pickup capacity of the microphone 50 and selectively pick up the sounds of spaced-apart instruments without also picking up ambient sounds or noise. It should be apparent that the adjustable sound capturing device 2 can be attached to a variety of conventional microphones and will adjust to their size, thereby allowing musicians to use a single existing microphone to do the job of two. This reduces the number of accessories required for recording and live performances (stands, clips, cables, etc). Moreover, the adjustable sound capturing device 2 is durable and portable, and well-suited for touring productions because it reduces the number of microphones that need to be transported for live performances. This solution is more economical and cost-effective than purchasing multiple microphones and mixing them electronically, it requires no power source, contains no electronics, and is much simpler to use. It also greatly reduces bleed-over problems associated with current microphones and miking techniques.

Having now fully set forth a detailed example and certain modifications incorporating the concept underlying the present invention, various other modifications will obviously occur to those skilled in the art upon becoming familiar with said underlying concept. For example, the two-port configuration may be easily increased to three or more ports to accommodate more instruments, the radii of the ports may vary, and the tubes may vary in length, diameter or thickness. Materials other than plastic may be used in the construction, the flexibility of the device may be altered, and other fastening means may be employed to fasten the device to the microphone. Acoustical materials may be incorporated in the tubes to alter captured sounds, and the closed ends of the end tubes could be removable. It is to be understood, therefore, that within the scope of the appended claims, the invention may be practiced otherwise than as specifically set forth in the appended claims.

I claim:

1. An adjustable sound capturing device, comprising:

an open-ended hollow main cylinder having a microphone port defined in a side wall thereof a plurality of hollow cylindrical end tubes each being closed at one end and open at one end, said open end being adapted for an articulating friction fit onto a respective end of said main cylinder, and each of said end tubes being defined by an acoustic input port proximate said closed end;

an adjustable fastener comprising a collar mounted about said microphone port of the main cylinder for insertion of a microphone therein, and a hook and loop fastening strap for tightening said collar about the microphone head for removable attachment of a microphone inserted therein.

2. The adjustable sound capturing device according to claim 1, wherein said open-ended main cylinder has a microphone port defined centrally therein.

3. The adjustable sound capturing device according to claim 1, wherein said plurality of hollow cylindrical end tubes are rotatable about said articulating friction fit on said main cylinder.

4. The adjustable sound capturing device according to claim 3, wherein said plurality of hollow cylindrical end tubes telescope outward from said main cylinder.

5. The adjustable sound capturing device according to claim 1, wherein each of said plurality of hollow cylindrical end tubes is defined by an aperture proximate said closed end.

6. The adjustable sound capturing device according to claim 1, wherein said end tubes and said main cylinder are formed of sound dampening material.

7. The adjustable sound capturing device according to claim 6, wherein said sound dampening material comprises plastic.

8. The adjustable sound capturing device according to claim 7, wherein said plastic comprises PVC plastic.

9. An adjustable sound capturing device, comprising:

an open-ended hollow main tube having a microphone port defined in a side wall thereof a pair of hollow cylindrical end tubes each being closed at one end and open at one end, said open ends being adapted for an articulating fit onto a respective end of said main tube, and each of said end tubes being defined by an acoustic input port proximate said closed end;

an adjustable fastener comprising a collar mounted about said microphone port of the main cylinder for insertion of a microphone therein, and a hook and loop fastening strap for tightening said collar about the microphone head for removable attachment of a microphone inserted therein.

10. The adjustable sound capturing device according to claim 9, wherein said open-ended main tube has said microphone port located centrally there along.

11. The adjustable sound capturing device according to claim 9, wherein said end tubes are rotatable about said main tube.

12. The adjustable sound capturing device according to claim 11, said end tubes telescope outward from said main tube.

13. The adjustable sound capturing device according to claim 9, wherein said end tubes and said main tube are formed of sound dampening material.

14. The adjustable sound capturing device according to claim 13, wherein said sound dampening material comprises plastic.

15. The adjustable sound capturing device according to claim 14, wherein said plastic comprises PVC plastic.

16. The adjustable sound capturing device according to claim 9, wherein said acoustic input ports of said end tubes are located along the outer periphery adjacent said closed end.

* * * * *